US006012596A

United States Patent [19]

Oglesbee et al.

[11] Patent Number: 6,012,596

[45] Date of Patent: Jan. 11, 2000

[54] ADAPTOR CAP

[75] Inventors: Richard K. Oglesbee, Lancaster; William J. Hook, Westerville; Julie L. Soltesz, Hilliard, all of Ohio

[73] Assignee: Abbott Laboratories, Abbott Park, Ill.

[21] Appl. No.: 09/044,599

[22] Filed: Mar. 19, 1998

[51] Int. Cl.[7] ..... B65D 53/00

[52] U.S. Cl. ..... 215/261; 215/232; 215/308; 215/309; 215/352; 215/DIG. 3; 141/59; 141/286; 141/330

[58] Field of Search ..... 215/232, 258, 215/261, 307, 308, 309, 352, DIG. 3; 141/59, 286, 330

[56] References Cited

U.S. PATENT DOCUMENTS

| | | | |
|---|---|---|---|
| D. 330,332 | 10/1992 | Pezzoli et al. . | |
| 3,000,540 | 9/1961 | Wheeler | 141/330 X |
| 3,005,455 | 10/1961 | Poitras et al. | 215/307 X |
| 3,952,902 | 4/1976 | Prouty et al. . | |
| 4,235,344 | 11/1980 | Kulle et al. | 215/250 |
| 4,768,568 | 9/1988 | Fournier et al. | 141/330 X |
| 4,934,545 | 6/1990 | Pezzoli et al. . | |
| 4,951,845 | 8/1990 | Pezzoli et al. | 215/250 |
| 5,188,628 | 2/1993 | Rani et al. | 215/261 X |
| 5,437,655 | 8/1995 | Bartholomew | 141/330 X |

*Primary Examiner*—Stephen K. Cronin
*Attorney, Agent, or Firm*—Brian R. Woodworth; Daniel J. Hulseberg

[57] ABSTRACT

An adaptor cap for a container. The adaptor cap includes a skirt constructed to engage a fluid container and to retain the adaptor cap on the fluid container. The adaptor cap further includes a dome projecting outwardly from said skirt. The dome defines an interior chamber. The dome further defines a spike port providing fluid communication between the chamber and an exterior environment of the dome, the spike port being constructed to receive and retain a hollow spike therein. The dome also defines at least one vent aperture therethrough, the vent aperture providing fluid communication between the chamber and the exterior environment of the dome. The adaptor cap further includes a microbial filter mounted on the dome across the vent aperture.

20 Claims, 5 Drawing Sheets

ADAPTOR CAP

TECHNICAL FIELD

The present invention relates to an overcap for a sealed container which is intended to be punctured with a hollow spike and then hung in an inverted position to permit the liquid contents in the container to flow through the spike and through tubing connected to the spike for delivery to a patient. The adaptor cap of the present invention is especially suitable for use with a foil sealed bottle containing a liquid nutritional product.

BACKGROUND OF THE INVENTION AND TECHNICAL PROBLEMS POSED BY THE PRIOR ART

In healthcare facilities, patients who are critically ill, weak, or comatose may be unable to chew their food. For such patients, nourishment may be provided with a nutritional liquid using a conventional enteral feeding process. Enteral feeding can be conducted using a variety of techniques. One technique utilizes a nasogastric tube which is inserted through the patient's nasal cavity and into the patient's gastrointestinal tract. The exterior end of the tube can be fluidly connected to a container of an enteral nutritional product. A second technique utilizes a gastrostomy or jejunostomy tube which is inserted through the patient's abdominal wall directly into the patient's gastrointestinal tract. Here again, the exterior end of the tube can be fluidly connected to a container of an enteral nutritional product.

U.S. Pat. No. 4,934,545 discloses one conventional container for an enteral nutritional product. The container includes an opening that is initially closed with a seal which is typically a foil membrane or thin plastic membrane. An adaptor cap is threaded onto the end of the container over the membrane seal. The adaptor cap includes a spike port which is initially occluded with a frangible membrane that is unitary with the cap and that can be pierced or broken away as the spike is inserted through the port. The spike is inserted through the port frangible membrane and is inserted further to also pierce the foil or plastic membrane which initially seals the container opening. The adaptor cap also includes a vent aperture and a microbial filter across the vent aperture for admitting air to facilitate draining of the bottle.

Typically, a plurality of such containers (with the adaptor caps mounted thereon) are packed in a corrugated carton for shipping and storage. The cartons may be stacked one on top of the other, and this subjects the containers to vertical loading. In order to protect the adaptor cap, a separate overcap or dome piece is mounted on the top of the adaptor cap. The overcap or dome piece has a generally flat exterior surface for accommodating vertical loading. The overcap or dome piece also serves as a barrier against contaminant ingress. The overcap or dome piece must also present a sufficiently large, upwardly facing, flat surface to distribute the force and prevent the overcap from puncturing the top of the carton.

One such conventional overcap or dome piece is illustrated in the U.S. Pat. No. Des. 330,332, and the overcap or dome piece is shown in that patent mounted to the top of an adaptor cap. Although such an overcap or dome piece functions generally satisfactorily, it would be desirable to provide an improved system which would accommodate more economical manufacture. Further, it would be advantageous if such an improved system could provide an enhanced barrier against contaminant ingress.

Typically, the overcap or dome piece is designed to be snap-fit onto the adaptor cap. This requires relatively close molding tolerances which increase the manufacturing cost. It would be desirable to provide an improved system which could be manufactured with greater tolerances and at less cost while providing the same or superior functionality.

When a healthcare facility uses a container having an adaptor cap and overcap assembly as illustrated in the U.S. Pat. No. Des. 330,332, a healthcare professional must initially remove the separate overcap to expose the adaptor cap. The overcap, which is a rigid, thermoplastic molded structure, then becomes a significant waste material requiring disposal. It would be desirable to provide an improved adaptor cap system which could substantially minimize, if not altogether eliminate, the requirement to remove and dispose of a separate, rigid plastic overcap.

The conventional adaptor cap and overcap assembly illustrated in the U.S. Pat. No. Des. 330,332 includes a pierceable membrane recessed within, and across, the spike port. While such a design functions satisfactorily, it would be desirable to provide an improved design which would permit easier insertion of the spike while at the same time providing enhanced spike retention. Further, it would be advantageous to provide a system which would provide an enhanced contaminant barrier for the exterior portion of the spike port and for the exterior portion of the adaptor cap around the filter.

The prior art filter employed in the design illustrated in U.S. Pat. No. Des. 330,332 must be initially retained in a holder by staking, and then the filter holder must be pressed into the adaptor cap. While this assembly functions satisfactorily, it would be desirable to provide a less complex and less costly filter retention system.

The conventional adaptor cap illustrated in the U.S. Pat. No. Des. 330,332 includes a separate, annular rubber or plastic gasket for sealing against the top of the container. It would be advantageous if an improved adaptor cap could be provided with an enhanced gasket system which, inter alia, would not require the handling and assembly of a separate gasket during manufacture.

Finally, it would be desirable to provide an improved, user-friendly, system for exposing the adaptor cap spike port and vent aperture just prior to insertion of the spike. Further, it would also be advantageous to provide such a system with a tamper-evident feature that would clearly alert the healthcare professional to a condition in which the contaminant ingress barrier seal has been breached.

The present invention provides an improved adaptor cap which can accommodate designs having the above-discussed benefits and features.

SUMMARY OF THE INVENTION

The present invention provides an improved adaptor cap for ready-to-hang sealed bottles of liquid, such as a liquid nutritional product or other liquid which is to be discharged from the bottle through a hollow spike inserted into the adaptor cap and through a seal across the mouth of the bottle.

The improved adaptor cap can be more easily manufactured and can be manufactured at less cost.

The improved adaptor cap includes an improved system for retaining the spike in the adaptor cap and for retaining the filter in the cap.

The adaptor cap also incorporates a system for enhancing the sealing of the spike port and filter area from external contaminants.

The improved adaptor cap can also incorporate an improved gasket and process for placing a gasket on an adaptor cap.

According to one aspect of the invention, the adaptor cap is designed to be mounted over a pierceable portion of a container and is designed to be penetrated by a hollow spike through which the container contents can be discharged for delivery to a patient. The adaptor cap includes a skirt for engaging the container to retain the adaptor cap on the container. The adaptor cap includes a load-bearing dome projecting outwardly from the skirt. The dome defines (1) an interior chamber, (2) a spike port establishing communication between the chamber and the exterior of the dome to receive and retain the hollow spike when the hollow spike is inserted therein, and (3) at least one vent aperture establishing communication between the chamber and the exterior of the dome. The adaptor cap also includes a microbial filter mounted to the dome across the vent aperture. Finally, the adaptor cap includes a removable seal which is releasably attached to the exterior of the dome over the vent aperture and spike port to establish a barrier against contaminant ingress.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

Figure 1:
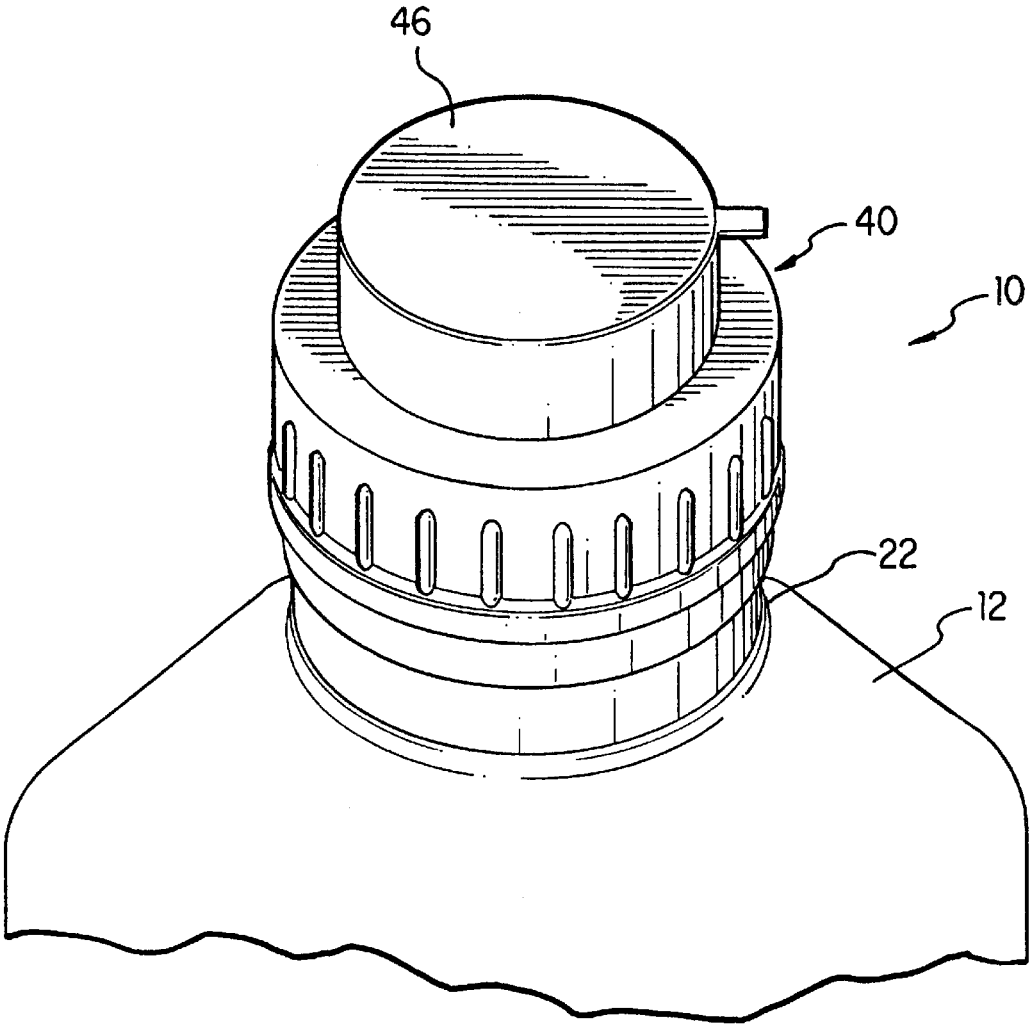
FIG. 1 is a fragmentary, perspective view of the improved adaptor cap of the present invention shown mounted on a membrane-sealed container which contains a liquid product.
Figure 4:
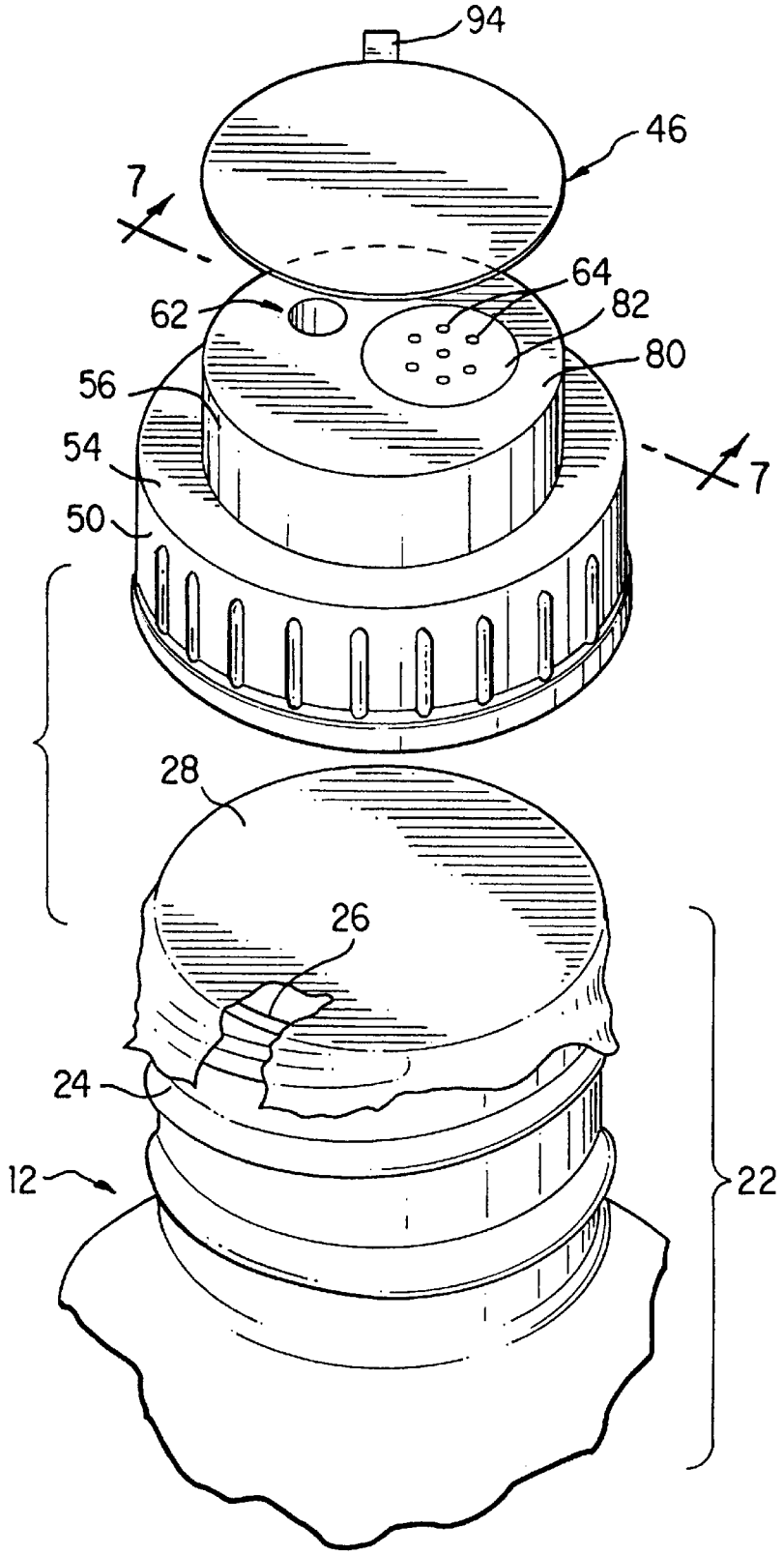
FIG. 4 is an exploded, perspective view showing the adaptor cap of FIG. 1 disengaged from, and above, the container.

An improved adaptor cap according to the present invention is generally designated in FIG. 1 by the reference number 10 and is shown in FIG. 1 mounted on the top of a bottle or other container 12 which typically contains a liquid, such as a liquid nutritional product, that is to be administered to a patient. As shown in FIG. 4, the container 12 typically includes a neck 22 defining an external thread 24. The neck 22 defines an opening 26 which is initially sealed by a membrane 28 which may be constructed of a known sealing material such as foil or plastic.

The container 12 may be a rigid or flexible container made from any suitable material which is compatible with the container contents and which provides other characteristics as may be desirable (opacity or transparency, oxygen barrier characteristics, capability of withstanding a particular sterilization technique, ease of manufacture, etc.). The structure of the membrane 28 and container 12 may be of a conventional design such as is incorporated in the nutritional product containers sold in the U.S.A. by Ross Products Division, Abbott Laboratories, Abbott Park, Ill., U.S.A.

In the embodiment of the present invention depicted in the accompanying figures, container 12 per se and the membrane 28 can be characterized as an assembly with which adaptor cap 10 of the present invention is intended to be used, and the assembly of the container 12 and membrane 28 may be characterized as not forming a part of the adaptor cap invention per se. However, in an alternative embodiment of the present invention, membrane 28 and adaptor cap 10 can be characterized as a single assembly constructed to fluidly seal container 12 and thereafter permit container 12 to be fluidly accessed using, for example, a spike of known construction.

The adaptor cap 10 is manufactured and mounted on container 12 by the manufacturer such that membrane 28 fluidly seals container 12 and such that adaptor cap 10 substantially covers membrane 28. A number of such capped containers can then be packaged together, e.g., in a corrugated carton, for shipping. The adaptor cap 10 protects the container membrane 28 from being damaged and prevents the membrane 28 from being contaminated during shipping, storage, and subsequent handling.

Figure 2:
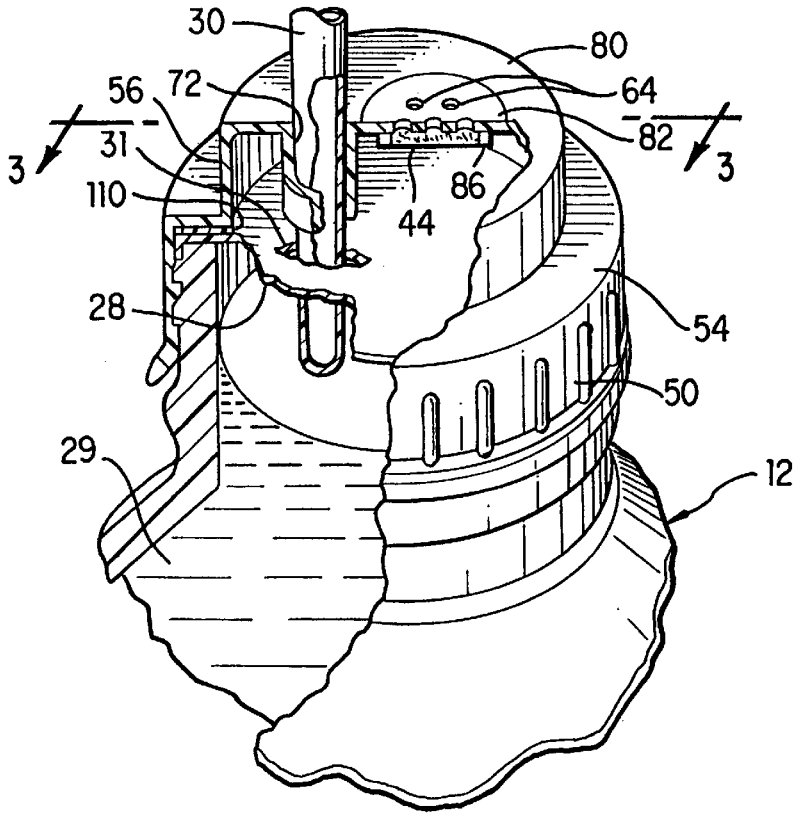
FIG. 2 is a fragmentary, perspective view similar to FIG. 1, but FIG. 2 shows the adaptor cap after a removable seal has been removed from the top of the cap and a hollow spike inserted through a spike port to pierce the membrane over the container opening, and portions of FIG. 2 have been broken away to illustrate interior detail.
Figure 3:
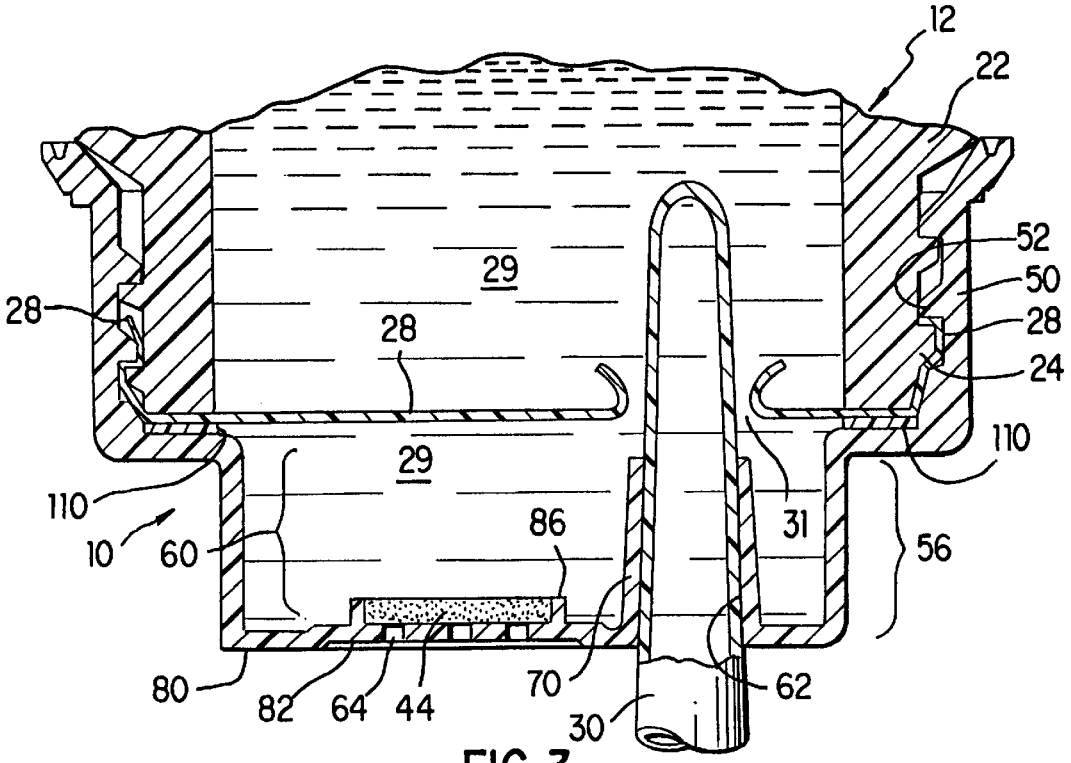
FIG. 3 is a fragmentary, cross-sectional view taken generally along the plane 3—3 in FIG. 2 and inverted to show the regions of the adaptor cap filled with liquid during administration of the liquid product to a patient.

The container 12 contains a liquid product 29 which can be administered to a patient through a tubing system (not illustrated) connected to a hollow spike 30 of known construction. As depicted in FIGS. 2 and 3, hollow spike 30 is constructed such that it can be inserted through a portion of the adaptor cap 10 in order to establish fluid communication between the tubing system and container 12. Thus, liquid 29 will flow from container 12, through hollow spike 30 and the tubing system, and into the patient when container 12, with the spike 30 attached through the cap 10, is hung upside down (FIG. 3) or when a pump of known construction and operation is used to move liquid 29 from container 12 to the patient. It will be appreciated, however, that the novel features of the adaptor cap of the present invention are not limited to applications involving the administration of a nutritional product to a patient.

Figure 5:
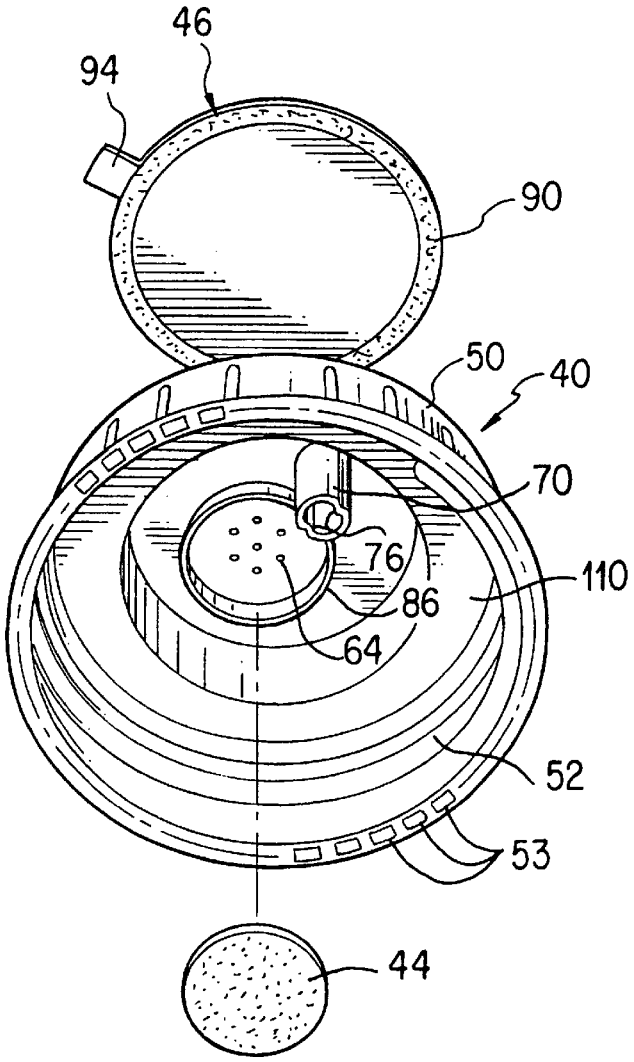
FIG. 5 is an exploded, perspective view of the components of the adaptor cap.
Figure 6:
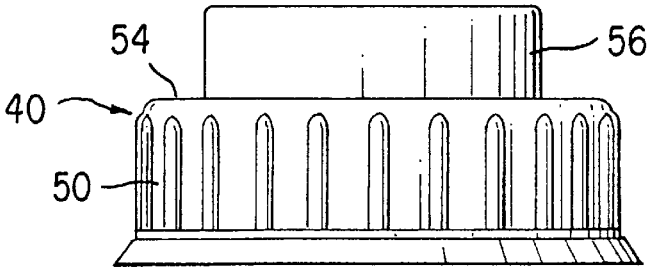
FIG. 6 is a side elevational view of the adaptor cap.
Figure 7:
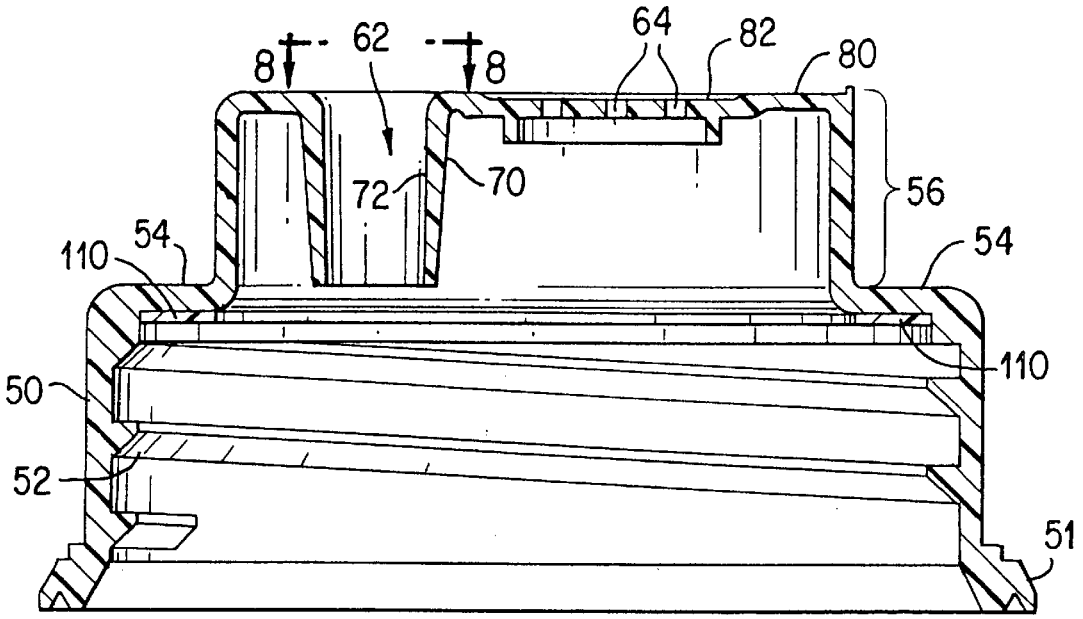
FIG. 7 is a cross-sectional view taken generally along the plane 7—7 in FIG. 4.
Figure 8:
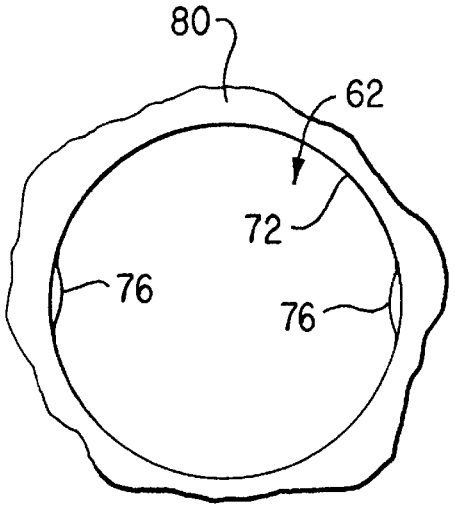
FIG. 8 is a greatly enlarged, fragmentary view taken generally along the plane 8—8 in FIG. 7.

With reference to FIGS. 1 and 5, the adaptor cap 10 comprises an initial assembly of four components or elements—a body 40, a gasket 110, a filter 44, and a removable seal 46. As shown in FIG. 7, the body 40 has a peripheral skirt 50 which defines an internal thread 52 for engaging the container thread 24 (FIG. 4). Other suitable attachment structures and methods could be provided (e.g., a snap-fit bead and groove system, a permanent adhesive or welded attachment system, etc.).

For the purposes of this disclosure, the term "skirt" is used to refer to the portion of adaptor cap 10 that is constructed to engage container 12. In the embodiments of the invention depicted in the accompanying figures, container 12 is a bottle. Accordingly, skirt 50 is constructed such that it extends about an external surface of a mouth of the bottle. However, it will be appreciated that container 12 can be any of a variety of fluid-containing structures. For example, if container 12 is a flexible pouch, skirt 50 preferably will be in the form of a flange having a surface constructed to engage the flexible pouch. Thus, the term "skirt" is intended to refer to any structure constructed to engage a surface of a fluid container without regard to the construction of the container.

As depicted in FIG. 7, flange portion 51 extends radially outwardly and downwardly from the remainder of skirt 50. Flange portion 51 acts as a leading flange which facilitates proper alignment between container 12 and adaptor cap 10 as adaptor cap 10 is placed on container 12. Flange portion 51 also facilitates placement of adaptor cap 10 over membrane 28.

As illustrated in FIG. 5, the bottom edge of the skirt 50 includes a plurality of ratchet teeth 53 which are equally spaced and which may function as engageable members for being engaged by a suitable tool to assist in removing the body 40 from a mold when the body 40 is molded from thermoplastic material.

The upper end of the skirt 50 includes a radially inwardly extending shoulder 54. A dome 56 projects upwardly from the inner radius of the skirt shoulder 54. The dome 56 defines an interior chamber 60, a spike port 62, and a plurality of vent apertures 64.

The spike port 62 establishes communication between the chamber 60 and the exterior of the dome 56. The spike port 62 receives the hollow spike 30 when the hollow spike 30 is inserted therein (as shown in FIG. 2). The spike port 62 is defined by an internal projection 70 which extends inwardly into the chamber 60. The projection 70 has a generally frustoconical surface 72 extending through the projection 70 to define the spike port 62.

The spike port 62 has a larger diameter at the exterior top of the dome 56 and has a smaller diameter at the distal end of the projection 70 in the chamber 60. In one presently contemplated embodiment, the diameter of the spike port 62 at the top (exterior) of the dome 56 is about 0.199 inch, and the frustoconical surface 72 has a one half degree taper along at least a portion of the length of projection 70. The taper causes a friction or interference fit between projection 70 and spike 30 comparable to a common luer connection. Also in the presently contemplated embodiment, the bottom, distal end of the projection 70 has an internal diameter of about 0.194 inch. In the contemplated embodiment, the length of the projection, from the upper or exterior surface of the dome 56 to the distal end of the projection 70 in the cavity 60 is about 0.375 inch.

The projection 70 also includes a pair of opposed protuberances 76 which project from the frustoconical surface 72. The protuberances 76 extend generally along at least a portion of the length of the spike port 62 so as to provide an interference fit with the spike 30. It has been found that the interference fit created as a result of protuberances 76 is stronger than the interference fit created between a spike and port that is circular in cross-section along its length.

The body dome 56 has a top which defines a surface 80. Surface 80 is preferably constructed to be a load-bearing surface such that containers 12 having adaptor caps 10 can be stacked on top of one another. The dome 56 also defines a region 82 which preferably is recessed in the surface 80. In the embodiment of the present invention depicted in the accompanying figures, seven vent apertures 64 extend through the flat surface 82. However, it will be appreciated that the number of vent apertures can be varied without departing from the scope of the present invention. Each of the vent apertures 64 preferably has a frustoconical configuration with a five degree taper. In one presently contemplated embodiment, the upper, exterior end of each vent aperture 64 has a diameter of about 0.060 inch. The number, shape, size, and configuration of the vent apertures 64 are not critical, and other arrangements may be employed.

The dome 56 defines an annular flange 86 projecting inwardly into the chamber 60 around the vent apertures 64. The filter 44, which has a disk-like configuration, is disposed within the annular flange 86. Filter 44 can be a thin disk woven from a synthetic, semi-permeable, hydrophobic fiber material. In the embodiment of the present invention depicted in the accompanying figures, filter 44 is secured to the interior dome adjacent to the vent apertures 64 using known methods and materials. For example, a suitable permanent, pressure-sensitive adhesive applied generally around the perimeter of the filter 44 can be used to secure filter 44 to dome 56. Alternatively, filter 44 can be secured to dome 56 by a heat staking process in which side walls 86 are heated until they are softened and then the softened walls are urged inwardly such that they retain filter 44 on dome 56.

In an alternative embodiment, filter 44 is positioned on an exterior surface of dome 56 and over vent apertures 64. Filter 44 can be attached to dome 56 using a variety of known methods and materials, including, but not limited to, pressure-sensitive adhesive and/or heat staking, as above-discussed.

The removable seal 46 includes a generally disk-like, flexible membrane. Seal 46 can be secured to dome 56 using a releasable, pressure-sensitive adhesive provided on one or both of seal 46 ad dome 56. In FIG. 5, an annular band of pressure-sensitive adhesive on the periphery of the seal 46 is designated generally by the reference numeral 90. Alternatively, seal 46 can be induction welded to dome 56. It is believed that induction welding of seal 46 onto dome 56 will enhance the ability of a user to determine whether seal 46 has been previously removed or altered from dome 56, i.e., tamper evidence.

Preferably, the membrane 46 includes a tab 94 which extends generally radially outwardly from the disk-like membrane and which can be grasped to facilitate removal of the seal 46 from the dome 56. The seal 46 is secured with the adhesive 90 to the dome top surface 80 around the outside of the spike port 62 and vent aperture 64. The seal 46 may be fabricated from a thermoplastic film or conventional paper coated with a varnish or other surface sealant. The seal 46 will prevent passage of contaminants from the ambient surroundings into and through the cap vent apertures 64 and spike port 62. The seal 46 may also be fabricated from other suitable materials. The seal may also be imprinted with indicia, including label information, opening instructions, etc.

Figure 9:
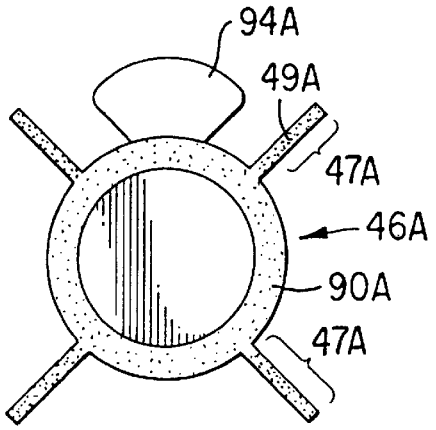
FIG. 9 is a plan view of the underside of a second embodiment of the removable seal.

If desired, the seal 46 may be modified to provide tamper-evidence characteristics. Specifically, with reference to FIG. 9, a modified form of a seal 46A is illustrated as having four arms or strips 47A extending radially outwardly as unitary extensions from the disk-like central membrane. A permanent, pressure-sensitive adhesive 49A is coated on the strips 47A for securing each strip 47A to the sidewall of the cap dome 56. Releasable, pressure-sensitive adhesive 90A is employed on the annular periphery of the central, disk-like membrane of the seal 46A in the same manner as the pressure-sensitive adhesive 90 in the first embodiment of the seal 46 described above with reference to FIG. 5. The second embodiment of the seal 46A also preferably includes an outwardly extending tab 90A which can be grasped to pull the seal away from the top of the cap dome. As the seal 46A is pulled away from the cap dome, the—permanent adhesive connection between the strips 47A and the dome remains strong and is not broken. Rather, the seal material itself breaks at the locations where the strips 47A join the edge of the central, disk-like portion of the seal 46A. The strips 47A thus remain attached to the dome 56 while the remainder of the seal 46A is pulled away. The strips 47A remaining on the cap serve as evidence that the seal has been removed.

Preferably, the adaptor cap body 40 is molded from a thermoplastic polymer resin, such as the polypropylene resin sold under the designation Huntsman P4G4Z-011 by Huntsman Corp. having an office at Salt Lake City, Utah, U.S.A. In a presently contemplated embodiment, the overall height of the cap body 40 is about 0.987 inch, the thread internal diameter is about 1.497 inches, the thread root diameter is about 1.594 inches, the internal diameter of the annular flange 86 inside the cap dome 56 around the filter 44 is about 0.360 inch, the length of the spike port 62 is about 0.375 inch, and the internal diameter of the spike port 62 at the top (exterior) of the dome 56 of the cap is about 0.199 inch.

Preferably, the adaptor cap body 40 is molded by co-injection or two-shot, bi-injection molding wherein a gasket 110 (FIG. 7) is molded into the cap body 40 against the shoulder 54. In one contemplated embodiment, the gasket material is the product sold under the designation Kraton D by the Shell Chemical Co. which has an office at Houston, Tex., U.S.A. This material has a hardness of about 40 Shore A. It is molded into the cap body 40 to form a gasket 110 having a thickness of about 0.06 inch.

In an alternate embodiment (not illustrated), the shoulder 54 and gasket 110 are eliminated and the dome 56 extends from the skirt 50 with the same diameter as the skirt 50. Appropriate sealing features would be provided around the internal periphery of the skirt to prevent leakage past the threads (or other structure that may be employed to attach the adaptor cap to the container 12).

The filter 44 may be cut into a disk-like shape from a sheet of commercially available material, such as the porous composite product sold under the designation Paliflex by Pall Corporation having an office at Port Washington, N.Y., U.S.A. This type of material is hydrophobic, and functions when wetted (as with the liquid 29 in the container 12) to permit passage of atmospheric air through the filter, but without bacteria which is filtered and retained by the filter 44. The filter 44 will thus permit air, but not bacteria, to enter the container 12 to facilitate the draining of the container.

If desired, the adaptor cap 10 may include other modifications. For example, a chemical or chemicals may be added to the spike port 62 or the area around the spike port 62 prior to applying the seal 46 on the top of the adaptor cap dome 56. Such a chemical or chemicals may serve to sterilize the spike port region.

In order to use the system, the healthcare professional pulls off the seal 46 and inserts the spike 30 into the spike port 62 as illustrated in FIG. 2. The spike 30 is inserted far enough so as to tear and pierce the container foil seal membrane 28. Spike 30 also is inserted such that an interference fit is created between spike 30 and frustoconical surface 72, as above-discussed. This creates an irregular puncture with extending openings or tear regions 31 in the foil membrane (FIG. 2) around the spike 30. The healthcare professional then inverts the container 12 with the spike 30 retained therein and hangs the container from a suitable support (not shown). The inverted condition of the assembly is shown in FIG. 3. The liquid 29 within the container 12 flows through the tear openings 31 in the punctured foil membrane 28 and into the cavity 60 within the dome 56. The liquid 29 is thus in contact with the filter 44 and wets the filter. Air, but not bacteria, can pass through the filter 44 into the cap 10. The air flows through the openings 31 in the foil membrane 28 to assist in draining of the liquid 29 out of the container 12 through the spike 30.

The adaptor cap 10 of the present invention can be manufactured with simplified techniques and at less cost because the unitary cap body 40 does not require a separate dome piece or overcap. Further, the cap 10 of the present invention accommodates bi-injection molding of the gasket 110 directly into the cap body 40 so as to eliminate the separate manufacture of the gasket and subsequent storage, handling, and assembly of the gasket into the cap.

The flat dome of the cap functions very effectively to withstand static and dynamic loads during packaging, shipping, and handling, especially when a plurality of containers are packed together in a carton and when the cartons are stacked one on top of the other. The dome 56 protects the underlying membrane 28 on the container 12, yet the large top surface area of the dome 56 distributes the loading so that the dome will not punch through the carton. Further, the dome 56 and seal 46 eliminate, or at least minimize, the ingress of contaminants that might otherwise contact the underlying container membrane 28.

The adaptor cap 10 is easily used by a healthcare professional. The removable seal 46 on the top of the adaptor cap dome 56 becomes only a minimal waste product when the seal is removed. After removal, the seal 46 can be adhesively secured to the side of the container 12 so that subsequently the container 12 and seal 46 adhered to the side thereof can be disposed of together as a unit.

The improved configuration of the spike port 62 functions to enhance the capability of the cap 10 to retain the spike 30 during use. Nevertheless, because the adaptor cap 10 does not require a unitary, frangible membrane across the bottom of the spike port 62 as in prior art designs, the process of inserting the spike 30 into the cap 10 is easier.

It will be readily apparent from the foregoing detailed description of the invention and from the illustrations thereof that numerous variations and modifications may be effected without departing from the true spirit and scope of the novel concepts or principles of this invention.

What is claimed is:

1. An adaptor cap comprising:

a skirt constructed to engage a fluid container;

a dome extending from said skirt, said dome having a substantially flat exterior surface and defining an interior chamber, said dome further defining a spike port therethrough to provide fluid communication between said chamber and an exterior environment of said dome, said spike port constructed to receive and retain a hollow spike, said dome further defining at least one vent aperture therethrough to establish fluid communication between said chamber and the exterior environment of said dome; and a microbial filter provided on said dome across said vent aperture.

2. An adaptor cap in accordance with claim 1, said adaptor cap further comprising a removable seal releasably attached to the exterior surface of said dome over said at least one vent aperture and over said spike port, said removable seal providing a barrier against contaminant ingress through said at least one vent aperture and said spike port.

3. An adaptor cap in accordance with claim 1, wherein the external surface of said dome has a recessed region defined therein proximate said at least one vent aperture.

4. An adaptor cap in accordance with claim 1, wherein said microbial filter is constructed of a semi-permeable, hydrophobic fiber material.

5. An adaptor cap in accordance with claim 1, wherein said filter is secured on said dome with a permanent adhesive.

6. An adaptor cap in accordance with claim 1, wherein said dome defines an annular flange projecting inwardly into said chamber around said at least one vent aperture, and wherein said filter is disposed within said annular flange.

7. An adaptor cap in accordance with claim 1, wherein said skirt defines a thread to engage a mating thread on a fluid container.

8. An adaptor cap in accordance with claim 1, wherein said skirt includes a wall having an upper end portion, and an annular shoulder extending from said upper end portion of said wall to said dome.

9. An adaptor cap in accordance with claim 8, said adaptor cap further comprising a gasket provided on said annular shoulder.

10. An adaptor cap in accordance with claim 1, wherein said spike port includes a hollow projection extending into said chamber from said dome, said hollow projection terminating at a distal end within said chamber, said hollow projection defining a generally frustoconical surface.

11. An adaptor cap in accordance with claim 10, wherein said spike port includes a pair of opposed protuberances extending inwardly along at least a portion of a length of said generally frustoconical surface, said protuberances constructed to provide an interference fit with the spike when inserted into the spike port.

12. A container for containing a liquid, said container comprising:

a vessel to contain a liquid, said vessel defining an outlet;

a seal fluidly sealing said outlet defined by said vessel; and an adaptor cap including a skirt constructed to engage said vessel and to retain said adaptor cap thereon;

a dome extending from said skirt, said dome having a substantially flat external surface and defining an interior chamber, said dome further defining a spike port therethrough to provide fluid communication between said chamber and an exterior environment of said dome, said spike port constructed to receive and retain a hollow spike, said dome further defining at least one vent aperture therethrough to establish fluid communication between said chamber and the exterior environment of said dome; and a microbial filter provided on said dome across said vent aperture.

13. A container in accordance with claim 12, wherein said adaptor cap further includes a removable seal releasably attached to the exterior surface of said dome over said at least one vent aperture and over said spike port, said removable seal providing a barrier against contaminant ingress through said at least one vent aperture and said spike port.

14. An adaptor cap comprising:

a skirt constructed to engage a fluid container;

a dome extending from said skirt, said dome defining an interior chamber, said dome further defining a spike port therethrough to provide fluid communication between said chamber and an exterior environment of said dome, said spike port constructed to receive and retain a hollow spike, said dome further defining at least one vent aperture therethrough to establish fluid communication between said chamber and the exterior environment of said dome;

a microbial filter provided on said dome across said vent aperture; and a removable seal releasably attached to an exterior surface of said dome over said at least one vent aperture and over said spike port, said removable seal providing a barrier against contaminant ingress through said at least one vent aperture and said spike port.

15. An adaptor cap in accordance with claim 14, wherein said exterior surface is substantially flat.

16. An adaptor cap in accordance with claim 14, wherein said removable seal includes a flexible membrane secured to said dome by a releasable adhesive.

17. An adaptor cap in accordance with claim 14, wherein said removable seal includes a disk-like membrane and at least one unitary strip extending therefrom, said at least one unitary strip being secured by a substantially permanent adhesive to said dome.

18. An adaptor cap comprising:

a skirt constructed to engage a fluid container;

a dome extending from said skirt, said dome defining an interior chamber, said dome further defining a spike port therethrough to provide fluid communication between said chamber and an exterior environment of said dome, said spike port including a hollow projection extending into said chamber from said dome to receive a hollow spike, said hollow projection defining a generally frustoconical surface terminating at a distal end within said chamber, said spike port further including a pair of opposed protuberances extending inwardly along at least a portion of a length of said generally frustoconical surface to provide an interference fit with said spike, said dome further defining at least one vent aperture therethrough to establish fluid communication between said chamber and the exterior environment of said dome; and a microbial filter provided on said dome across said vent aperture.

19. An adaptor cap in accordance with claim 18, said adaptor cap further comprising a removable seal releasably attached to an exterior surface of said dome over said at least one vent aperture and over said spike port, said removable seal providing a barrier against contaminant ingress through said at least one vent aperture and said spike port.

20. An adaptor cap in accordance with claim 18, wherein said dome has a substantially flat exterior surface.

* * * * *